United States Patent [19]

Adleman et al.

[11] Patent Number: 4,543,722

[45] Date of Patent: Oct. 1, 1985

[54] SLUG-SPLITTING PUNCH

[75] Inventors: Larry G. Adleman; Richard H. Malanaphy, both of Rockford, Ill.

[73] Assignee: Ex-Cell-O Corporation, Troy, Mich.

[21] Appl. No.: 461,406

[22] Filed: Jan. 27, 1983

[51] Int. Cl.[4] ..... B26F 1/00

[52] U.S. Cl. ..... 30/360; 83/688

[58] Field of Search ..... 30/360, 361, 359, 366, 30/367, 443, 446; 72/325, 326; 83/689, 688

[56] References Cited

U.S. PATENT DOCUMENTS 1,817,223 8/1931 Abramson et al. ..... 30/360

2,214,701 9/1940 Scull ..... 83/689

2,221,904 11/1940 Abramson et al. ..... 30/360

3,728,927 4/1973 Pfleiderer et al. ..... 83/688 X

*Primary Examiner*—Douglas D. Watts

*Attorney, Agent, or Firm*—Edward J. Timmer

[57] ABSTRACT

A male punch member is disclosed for use with a female die member to remove a slug in two pieces from a sheet metal workpiece. The working end of the punch member is specially configured to enable punching and splitting of a slug into two pieces from a wide range of materials such as 10-gauge, type 304 stainless steel while providing acceptable punch life.

17 Claims, 6 Drawing Figures

SLUG-SPLITTING PUNCH

FIELD OF THE INVENTION

The present invention relates to a punch member and, in particular, to a male punch member for removing a slug in two pieces from sheet metal and the like.

BACKGROUND OF THE INVENTION

Draw punches useful with a female die member to remove a slug from sheet metal are known in the art. For example, the following United States patents describe various draw punch constructions:

U.S. Pat. No. 1,721,007 issued July 16, 1929
U.S. Pat. No, 1,754,568 issued Apr. 15, 1930
U.S. Pat. No. 1,817,223 issued Aug. 4, 1931
U.S. Pat. No. 2,237,069 issued Apr. 1, 1941
U.S. Pat. No. 3,269,011 issued Aug. 30, 1966
British Pat. No. 1,415,620 and French Pat. No. 851,760 also disclose draw punches.

A disadvantage of these known draw punch constructions is that removal of the slug from the female die member, or draw shaft associated with the punch and die members for moving the male member into the female member, is often difficult and time-consuming. Frequently, another tool such as a screwdriver must be used to free the punched slug. None of the aforementioned patents appear to disclose a draw punch construction which splits or cuts the slug into two pieces for easy removal.

U.S. Pat. No. 4,353,164 issued Oct. 12, 1982 of common assignee herewith describes an improved draw punch capable of not only punching a slug from soft sheet metal such as mild carbon steel but also splitting the soft slug into two pieces for quick and easy removal.

SUMMARY OF THE INVENTION

An object of the invention is to provide a punch member capable of punching a slug from a workpiece and also splitting or cutting the slug into two pieces for easy removal from a cooperating female die member.

Another object of the invention is to provide such a punch member which will punch and split a slug from a wide range of metallic, plastic, or composite workpiece materials, in particular from heavier gauge austenitic stainless steels such as for example 10-gauge, type 304 stainless steel which prior art punch members have not been capable of satisfactorily punching.

The above objects and advantages of the invention are achieved in a typical embodiment by a novel arrangement of inclined surfaces and associated cutting edges and surfaces on the working face of the punch member. For example, a typical working embodiment of the invention includes a pair of first inclined surfaces oppositely disposed on the punch working face and sloping upwardly in opposite directions. The first inclined surfaces each have an outer peripheral edge forming a first outer cutting edge on opposite sides of the working face, partially around the working face periphery when viewed in plan. A pair of second inclined surfaces intersect the respective first inclined surfaces and also slope upwardly but at a steeper angle of inclination. The second inclined surfaces preferably slope upwardly in a direction transverse to that of the first inclined surfaces. The second inclined surfaces each have an outer peripheral edge forming a second outer cutting edge contiguous with the respective first cutting edges but more steeply inclined. In addition, the second inclined surfaces terminate laterally in respective laterally inclined cutting surfaces which slope upwardly in opposite directions toward and intersecting with the associated second outer cutting edge. The lateral cutting surfaces together form a generally V-shaped lateral cutting means across the working face. Further, the lateral cutting surfaces and second cutting edges together at their junction provide a generally pyramidal cutting section to provide triangular cutting patterns into the workpiece to initially pierce it and initiate lateral cutting or splitting of the slug from the slug periphery toward the slug center before a substantial portion of the slug periphery is cut. This arrangement assures that the slug is adequately supported while it is being split apart.

In particularly preferred embodiments of the invention, the first inclined surfaces are inclined planar surfaces and the second inclined surfaces are inclined planar surfaces intersecting the respective first inclined surfaces along a line of intersection parallel with a diameter extending across at least a portion of the working face and sloping upwardly transverse to the first planar surfaces and terminating in inclined lateral cutting surfaces extending across at least a portion of the working face. The lateral cutting surfaces may intersect one another at some location across the working face to, in effect, form a unitary generally V-shaped lateral cutting means or they may terminate in spaced apart ends.

The above objects, advantages and features as well as others will be understood in more detail by reference to the accompanying drawings and following detailed description.

DESCRIPTION OF PREFERRED EMBODIMENTS

Figure 2:
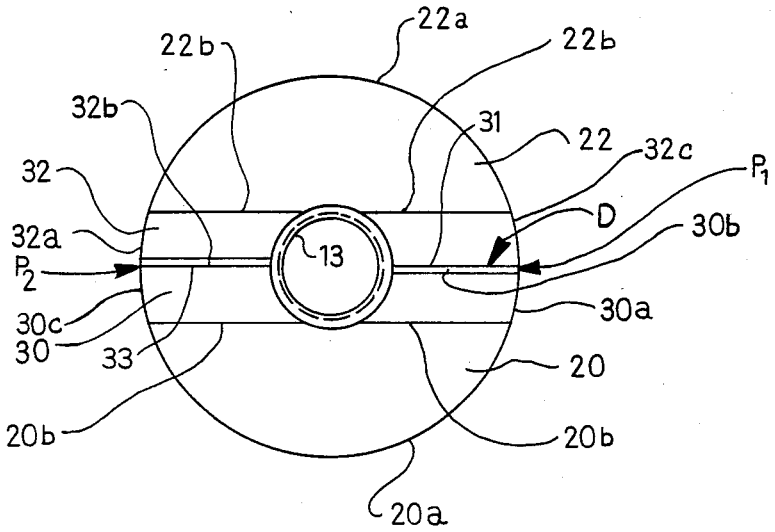
FIG. 2 is a top plan view of the punch member.
Figure 1:
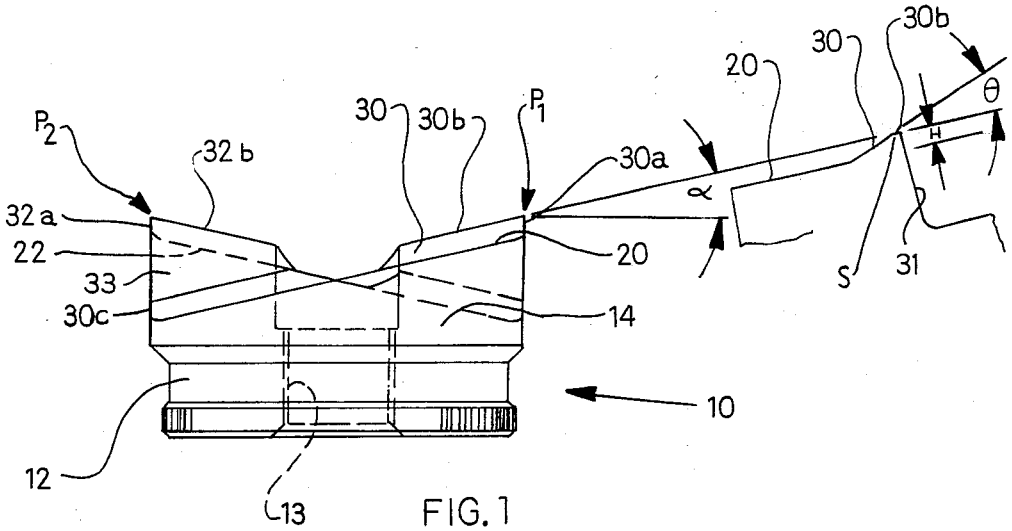
FIG. 1 is an elevation of the punch member and also includes a projection of the inclined surfaces.

FIGS. 1 and 2 illustrate a preferred version of the present invention. In particular, a male punch member 10 is shown and useful for punching a two inch diameter hole through a sheet metal workpiece, such as 10-gauge, type 304 stainless steel. The male punch member 10 is used with a female die member well known in the art as well as a draw shaft also well known in the art, e.g., the general arrangement of male die member, draw shaft and female die member being shown in the prior art patents cited in the Background of the Invention section hereinabove. In these arrangements, it is apparent that the workpiece is provided with a pilot hole through which the draw shaft extends.

The punch member 10 includes a generally cylindrical punch body 12 having a threaded bore 13 extending axially therethrough for threadably receiving the threaded end of the draw shaft (not shown) in conventional fashion. The punch member 10 also includes a working face 14 transverse to its axis and having a novel arrangement of inclined surfaces and associated cutting edges and surfaces for not only punching but also splitting apart of the slug to be removed from the workpiece. For example, the working face 14 includes a pair of first inclined planar surfaces 20 and 22 on opposite sides of diameter D and bore 13. The first planar surfaces 20, 22 slope upwardly from the working face in opposite directions at an angle $\alpha$ of for example 13° in the particular embodiment shown. The first planar surfaces 20, 22 have outer circumferential or peripheral edges which form first outer cutting edges 20*a*, 22*a* around a large portion of the working face periphery when viewed in plan (FIG. 2). The planar surfaces 20, 22 also have inner chordal ends 20*b*, 22*b* parallel with and spaced from diameter D across the working face in plan view. These chordal ends 20*b*, 22*b* are intersected by a pair of second inclined planar surfaces 30, 32 extending laterally across the working face and sloping upwardly in a direction transverse to the direction of slope of the first planar surfaces as shown in FIG. 1. The second inclined planar surfaces 30, 32 slope upwardly from the lines of intersection at a steeper angle of inclination $\theta$ (for example, 20°) than the first planar surfaces 20, 22.

The inclined planar surfaces 30, 32 include outer peripheral edges forming second outer circumferential edges 30*a*, 32*a* and third cutting edges 30*c*, 32*c* around a small portion of the working face periphery when viewed in plan (FIG. 2). Importantly, the second inclined planar surfaces also terminate laterally across the working face on one side of the bore between the first inclined planar surfaces 20, 22 in narrow lateral cutting surfaces 30*b*, 32*b* which are generally flat across and in vertically and radially oriented third surfaces 31,33 on the other side of the bore between the first inclined planar surfaces. The third surfaces 31, 33 each extend vertically upward at a 90° angle from the respective second inclined planar surface and terminate at the respective lateral cutting surface 30*b*, 32*b* in spaced relation to the second inclined planar surface terminating at the cutting surface. From FIG. 1, it is apparent that the lateral cutting surfaces 30*b*, 32*b* extend generally toward one another and incline upwardly in opposite directions toward the associated second outer cutting edges 30*a*, 32*a* of the inclined planar surfaces 30, 32. The lateral cutting surfaces thus form a generally V-shaped lateral cutting means across the working face when viewed in elevation (FIG. 1).

Furthermore, the lateral cutting surfaces 30*b*, 32*b* at their junction $P_1$, $P_2$ with the respective second cutting edges 30*a*, 32*a* form a generally pyramidal-shaped piercing section S (FIG. 1) on diametrically opposite sides of the working face periphery to initially pierce the workpiece in a triangular pattern and initiate lateral cutting across the slug diameter before a substantial portion of the slug circumference is cut. The uppermost height, H, of the second cutting edges 30*a*, 32*a* above the respective first cutting surfaces 20*a* and 22*a* as well as their angle of slope and length (circumferential) is correlated with similar parameters for lateral cutting surfaces 30*b*, 32*b* to achieve this effect. The intersection of the lateral cutting surfaces 30*b*, 32*b* with the second cutting edges 30*a*, 32*a* in this manner insures that the slug will be peripherally supported during most of the time the lateral cutting or slug splitting is occurring. This feature prevents unwanted tearing and twisting of the slug during punching.

Figure 3:
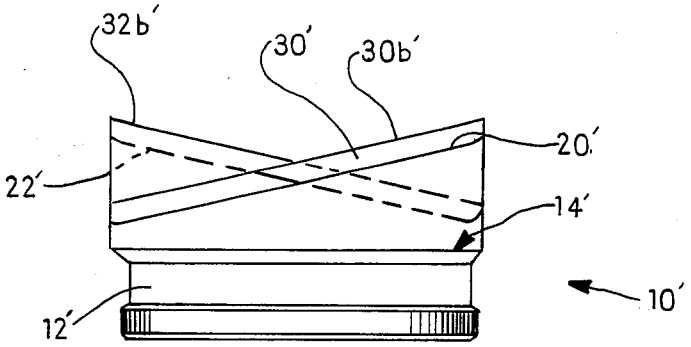
FIG. 3 is an elevation of another punch member where the lateral cutting surfaces intersect.
Figure 5:
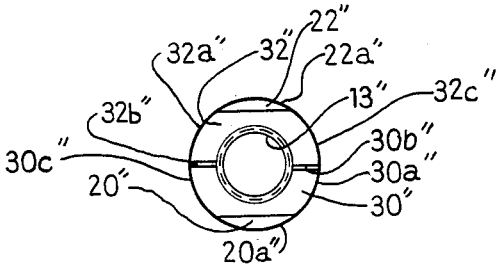
FIG. 5 is a top plan view of the punch member of FIG. 4.

FIG. 3 shows another embodiment of the invention where there is no axial bore in the punch member 10' and where the lateral cutting surfaces 30*b'*, 32*b'* intersect centrally on the working face. In FIG. 3, like features are represented by like numbers primed. It is apparent that the lateral cutting surfaces 30*b'*, 32*b'* form a V-shaped lateral cutting or splitting means across the working face in elevation. As used hereinabove and hereinafter, "V-shaped" merely means an elevational profile generally resembling a full V or open-ended (partial) V including a profile wherein the lateral cutting surfaces might be concave or convex across the working face. The choice of the particular shape for the lateral cutting means may be varied to suit specific applications so long as the lateral cutting surfaces 30*b*, 32*b* are upwardly divergent away from the working face as shown for example in FIGS. 1, 3 and 4.

Figure 4:
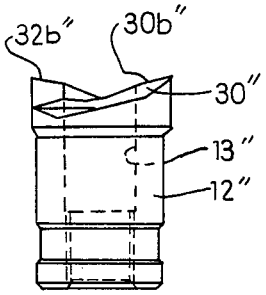
FIG. 4 is an elevation of still another punch member.

FIG. 4 shows still another embodiment of the punch member for punching and splitting a smaller slug such as a ½-inch diameter slug from a workpiece. In FIG. 4, like features are represented by like numerals double primed.

As a result of the particular construction of the present punch member, in particular the working face thereof, thicker, stronger material such as 10-gauge, type 304 stainless steel can be punched to remove a slug in two pieces. And, the punch life under such cutting conditions is adequate from a commercial product standpoint.

Figure 6:
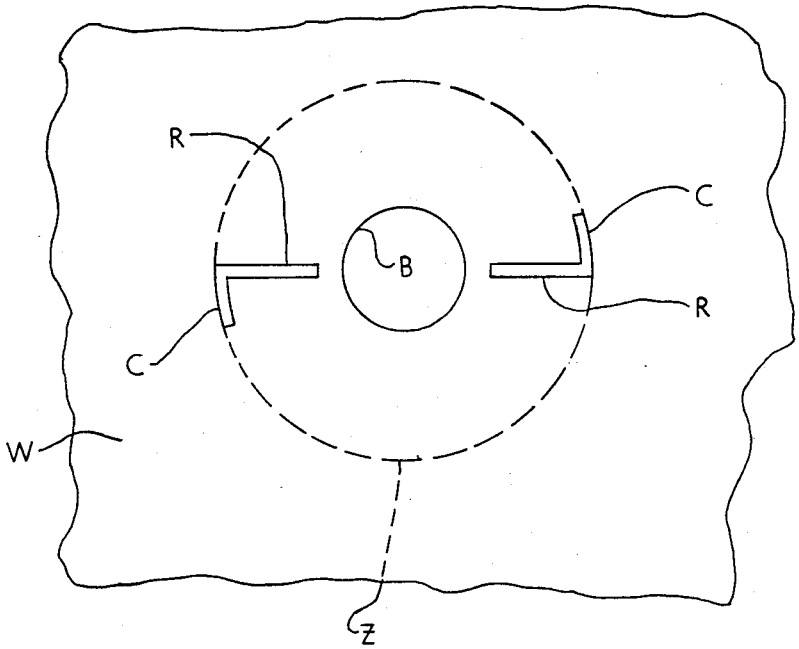
FIG. 6 is a top plan view of the workpiece showing the initial triangular cutting pattern into the workpiece.

In operation, the male punch member 10 is placed opposite the female die member (not shown) with the sheet metal workpiece therebetween. The male punch member and female die member are then brought together so as to progressively move the punch member working face into the workpiece. Initial penetration is by the pyramidal section S formed by the lateral cutting surfaces 30*b*, 32*b* at their juncture with second cutting edges 30*a*, 32*a* and this penetration constitutes a piercing action into the workpiece. As the pyramidal sections penetrate further, lateral cutting or splitting of the slug is initiated from the slug periphery toward the slug center before a significant part of the slug periphery is cut. FIG. 6 shows the initial triangular cutting pattern wherein radial cuts R progress toward center hole B in workpiece W while circumferential cuts C progress from the junction of the second cutting edges 30*a*, 32*a* and lateral cutting surfaces 30*b*, 32*b*. With further penetration, lateral splitting of slug Z continues and preferably is substantially complete before the first cutting edges begin cutting their portion of the slug periphery. Final cutting proceeds as the third cutting edges 30*c*, 32*c* and first cutting edges 20*a*, 22*a* cut toward one another. The entire slug periphery is thus cut and the slug is split apart into two pieces for easy removal.

While there have been described what are considered to be certain preferred embodiments of the invention, other modifications, changes, additions and the like may be made within the spirit and scope of the invention. For example, instead of the inclined surfaces being planar, helical or curvilinear inclined surfaces may be employed. The third cutting edges 30*c*, 32*c* formed by the second planar surfaces may instead be formed by the first planar surfaces 20, 22. The shape of the outer periphery of the punch may be such as to punch a hole other than circular, such as elliptical or rectangular. It is intended to cover in the appended claims all such modifications and the like as fall within the spirit and scope of the invention.

We claim:

1. A male punch useful with a female die member to remove an annular slug in two pieces from a workpiece, comprising an elongate punch body having an axial bore for alignment with a hole in the workpiece to receive means for moving said punch body inwardly and outwardly with respect to the female die member, said punch body having a working face with a pair of first inclined surfaces disposed on opposite sides of said bore and sloping upwardly in opposite directions, said first surfaces each having an outer peripheral edge forming a first outer cutting edge on opposite sides of said working face, and said working face further having a pair of second inclined surfaces each intersecting a respective one of said first inclined surfaces and sloping upwardly from the line of intersection toward one another when viewed in plan and at a steeper angle of inclination than said first inclined surfaces, said second inclined surfaces each having an outer peripheral edge forming a second inclined cutting edge contiguous with the respective first cutting edges and more steeply inclined and said second inclined surfaces and terminating at a respective lateral cutting surface on one side of said bore between the first inclined surfaces and at a respective third surface on the opposite side of said bore between the first inclined surfaces, said third surface extending upwardly from the respective second inclined surface at a steeper angle of inclination than said second inclined surfaces and terminating at said respective lateral cutting surface in spaced relation to said second inclined surface terminating thereat with the inclinations of the second inclined surface and third surface at the respective lateral cutting surface together exceeding 90° when viewed perpendicular to said axis in the direction of said respective lateral cutting surface, said respective lateral cutting surfaces sloping laterally upwardly from opposite sides of said bore in opposite directions between said respective second surface and third surface to the respective second cutting edge and extending upwardly above the working face from the opposite sides of said bore with said bore interrupting and separating the lateral cutting surfaces such that they are positioned above the working surface at the opposite sides of said bore to a sufficient height that the lateral cutting surfaces together form lateral cutting means extending across the working face except for said bore to cut competely across the slug to split it into two pieces on opposite sides of the hole in the workpiece, said first and second cutting edges cutting the slug periphery.

2. The male punch member of claim 1 wherein the second inclined surfaces slope upwardly from the line of intersection in a direction transverse to that of the first inclined surfaces.

3. The male punch member of claim 1 wherein said lateral cutting surfaces form a generally V-shaped lateral cutting means across the working face.

4. The male punch member of claim 1 wherein said lateral cutting surfaces are narrow flat surfaces.

5. The male punch member of claim 1 wherein the first inclined surfaces are inclined planar surfaces.

6. The male punch member of claim 5 wherein the second inclined surfaces are inclined planar surfaces.

7. The male punch member of claim 1 wherein the lateral cutting surfaces intersect one another at some location on the working face.

8. The male punch member of claim 1 wherein the lateral cutting surfaces terminate inwardly in spaced apart ends.

9. The male punch member of claim 8 wherein the punch body includes a central axial bore therethrough extending between the ends of said lateral cutting surfaces.

10. The male punch member of claim 1 wherein the lines of intersections of said first inclined surfaces and second inclined surfaces are parallel to a diameter through a circular working face.

11. A male punch member useful with a female die member to remove an annular slug in two pieces from a workpiece, comprising a cylindrical punch body having an axial bore for alignment with a hole in the workpiece to receive means for moving said punch body inwardly and outwardly with respect to the female die member, said punch body having a circular working face of selected diameter when viewed in plan with a pair of first inclined planar surfaces disposed on opposite sides of said bore and sloping upwardly in opposite directions, said first inclined surfaces each having an inner chordal side parallel to and spaced from said diameter and a circumferential edge forming a first cutting edge on opposite sides of said diameter and said working face further having a pair of second inclined planar surfaces extending across the working face except for said bore and each intersecting the chordal side of a respective one of said first inclined surfaces and sloping upwardly therefrom toward one another from opposite sides of said diameter when viewed in plan transverse to said first inclined surfaces and at a steeper angle of inclination, said second inclined planar surfaces each having an outer circumferential edge forming a second inclined cutting edge cntiguous with the respective first cutting edge and terminating at a respective generally radial cutting surface on one side of said bore between said first inclined surfaces and at a respective third surface on the opposite side of said bore between said first inclined surfaces, said third surface extending upwardly relative to the working face from the respective second inclined surface at a steeper angle of inclination than said second inclined surfaces and terminating at said generally radial cutting surface in spaced relation to said second inclined surface terminating thereat with the inclinations of the second inclined surface and third surface at the respective lateral cutting surface exceeding 90° when viewed perpendicular to said axis in the direction of said respective generally radial cutting surface, said respective generally radial cutting surfaces being offset from opposite sides of said diameter in parallel, spaced apart relation and sloping upwardly in opposite directions parallel with said chordal sides between said second inclined surfaces from said bore to said second cutting edge and extending upwardly above the working face from the opposite sides of said bore with said bore interrupting and separating the lateral cutting surfaces such that they are positioned above the working surface at the opposite sides of said bore to a sufficient height that the cutting surfaces together form a generally V-shaped cutting means extending across said working face except for said bore to cut completely across the slug to split it into two pieces on opposite sides of the hole in the workpiece, said first and second cutting edges cutting the slug circumference.

12. The male punch member of claim 11 wherein the first cutting edges extend around a large portion of the working face circumference and the second cutting edges extend around a small portion of the working face circumference.

13. The male punch member of claim 11 wherein the lateral cutting surfaces and respective first surfaces slope upwardly at the same angle of inclination relative to said face.

14. The male punch member of claim 11 wherein the cutting surfaces are narrow flat surfaces.

15. The male punch member of claim 11 wherein the cutting surfaces intersect one another on said face.

16. The male punch member of claim 11 wherein the lateral cutting surfaces terminate inwardly in spaced apart ends.

17. The male punch member of claim 16 wherein the punch body includes a central axial bore therethrough extending between the ends of said lateral cutting surfaces.

* * * * *